US005805070A

United States Patent [19]

Eriksson

[11] Patent Number: 5,805,070

[45] Date of Patent: Sep. 8, 1998

[54] DEVICE FOR INDICATING A DESTROYED ARRESTER

[75] Inventor: Tomas S. Eriksson, Stockholm, Sweden

[73] Assignee: Telefonaktiebolaget LM Ericsson, Stockholm, Sweden

[21] Appl. No.: 704,604

[22] PCT Filed: Apr. 12, 1995

[86] PCT No.: PCT/SE95/00399

§ 371 Date: Sep. 18, 1996

§ 102(e) Date: Sep. 18, 1996

[87] PCT Pub. No.: WO95/28024

PCT Pub. Date: Oct. 19, 1995

[30] Foreign Application Priority Data

Apr. 12, 1994 [SE] Sweden ..... 9401232

[51] Int. Cl.[6] ..... G08B 21/00

[52] U.S. Cl. ..... 340/662; 340/638; 340/664; 361/119; 361/124; 337/32; 337/140

[58] Field of Search ..... 340/638, 639, 340/660, 662, 664; 361/117, 119, 124, 126; 337/31–32, 140, 176–178, 238–239, 290–291

[56] References Cited

U.S. PATENT DOCUMENTS 4,642,723 2/1987 Achtnig et al. ..... 361/124
4,876,626 10/1989 Kaczmarek ..... 340/650
5,172,295 12/1992 Hegnet et al. ..... 361/119
5,248,953 9/1993 Honl ..... 337/32
5,299,088 3/1994 Honl et al. ..... 361/119

FOREIGN PATENT DOCUMENTS

0471167 A1 6/1991 European Pat. Off. .
0516922 A2 2/1992 European Pat. Off. .

*Primary Examiner*—Jeffery Hofsass
*Assistant Examiner*—Daniel J. Wu
*Attorney, Agent, or Firm*—Burns, Doane, Swecker & Mathis, LLP

[57] ABSTRACT

A system for registering a malfunction in telecommunications equipment comprises a protective device including a terminal connector pin and a ground pin connected to ground. The system also includes a housing member for housing the protective device, the housing member including a conductive member attached thereto. A main failsafe switch connects the terminal connector pin to ground through the ground pin in the event of an overvoltage, while an alarm switch connects the conductive member attached to the housing member to ground in the event of the overvoltage. An overvoltage sensitive member contacts both the main failsafe switch and the alarm switch, and retracts both the main failsafe switch and the alarm switch while in a normal operating state of the telecommunications equipment. The overvoltage sensitive member releases both switches in the event of the overvoltage. The alarm switch contacts the conductive member in the housing in response to the overvoltage, which causes the generation of a perceptible alarm.

12 Claims, 4 Drawing Sheets

FIG. 6A
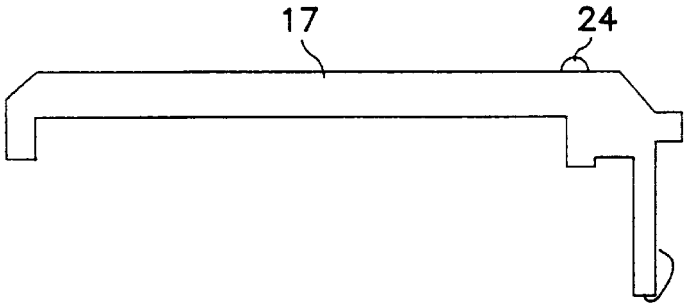
FIG. 6B
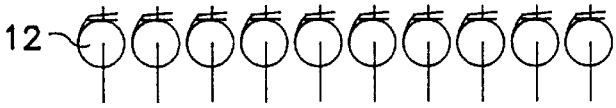
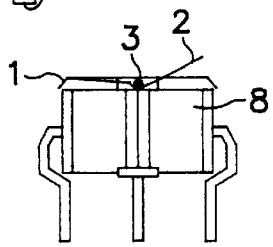
FIG. 6F
FIG. 6C
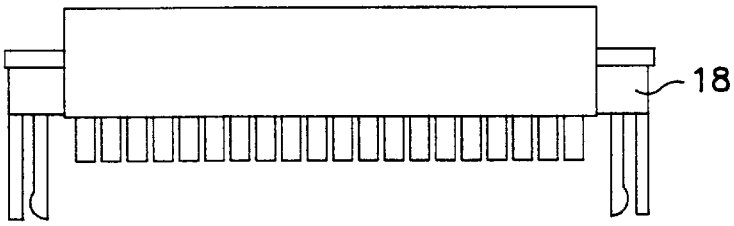
FIG. 6D
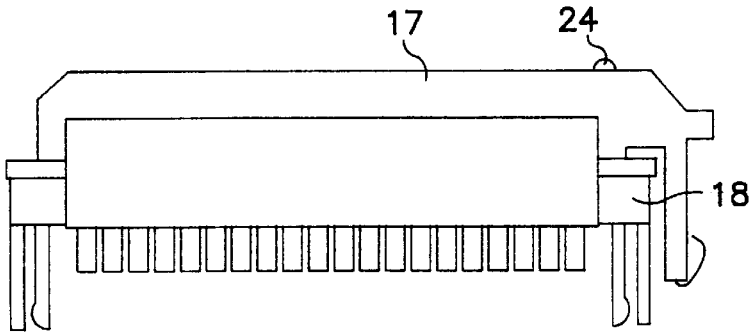
FIG. 6E
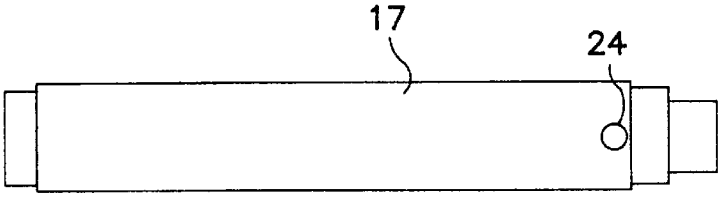

DEVICE FOR INDICATING A DESTROYED ARRESTER

TECHNICAL FIELD

The present invention relates to a device for registering the malfunction of a fuse or protective device included, for instance, in an overvoltage protection system in telecommunications equipment. In the event of an overvoltage protective device being overheated as a result of an overvoltage with risk of damage to the system, the event is registered by the inventive device so as to enable the protective device to be replaced.

DESCRIPTION OF THE BACKGROUND ART

A three-pole noble gas discharge tube (hereinafter called a protective device) is normally used to protect telecommunications equipment and telecommunication lines from overvoltages caused by lightening, or induced alternating voltages, or as a result of direct contact with power cables. The two wires of an incoming telecommunications line are normally protected with a protective device at the input to the main distribution frame of the station. The function of the protective device is to short-circuit the wires to earth should an overvoltage occur on the line, thereby protecting line interface boards and other equipment connected to the incoming telecommunications line from the damaging overvoltage. The protective device normally returns automatically to its standard state of very high resistance when the overvoltage ceases to appear. When a protective device is subjected to an A.C. overvoltage for a long period of time, the power loss in the protective device will cause the protective device to heat-up. This is liable to damage the cassette in which the protective device is mounted, since the cassettes are normally made of a plastic material. Heating of the protective device may also result in its own destruction. If the protective device is destroyed, it will act as a very large resistance between the telecommunications line and earth and will be unable to stop any further overvoltages on the telecommunications line. These overvoltages will instead reach the connected telecommunications equipment and cause damage thereto. Another problem is that the functional state of a protective device cannot be determined and measured without disconnecting the protective device from the telecommunications line. It is necessary to remove the protective device from the cassette in order to be able to measure its electrical properties and therewith establish whether or not the protective device has been destroyed.

There has been developed a failsafe device with the intention of solving part of this problem, this device having been in use for several years. A failsafe device functions to short-circuit the protective device immediately prior to its potential destruction. The failsafe device is triggered by the heat emitted by the protective device and is typically comprised of a spring-loaded electric contact which is held retracted in a piece of material which melts when heated, so as to release the electrical contact when the protective device reaches a given temperature. As the electrical contact is released, it moves towards the poles or terminals of the protective device and short-circuits the terminals to earth. When a protective device fitted with a failsafe device is destroyed, the station is able to carry out measurements on the connected telecommunications line to ascertain whether or not the line has been short-circuited to earth.

However, a telecommunications line can be short-circuited to earth by a number of different causes, and not only because a protective device provided with a failsafe device has been destroyed. Thus, it is not possible for station personnel to be sure that a specific telecommunications line has been earthed due to a destroyed protective device or as a result of an external short-circuit. Earthing of a telecommunications line is therefore an unreliable indication that a protective device has been destroyed.

SUMMARY OF THE INVENTION

With the intention of giving a reliable indication as to whether or not a protective device has been destroyed, there has been constructed a protective device and a system which are designed to indicate reliably that a protective device has been destroyed and nothing else. The most important part of this system is a novel type of failsafe device that includes an alarm function, hereinafter called an alarm failsafe device, which behaves in precisely the same manner as a typical failsafe device in short-circuiting pins/terminals on a protective device when said device is heated to a critical temperature and which, at the same time, short-circuits a signal circuit to indicate the position of the failsafe device. This function is achieved by providing the protective device with an additional electric contact spring—an alarm spring—which is held retracted by the same piece of meltable material as that in which a main failsafe spring is held retracted. Whereas the main failsafe spring is designed and biassed to move towards the protective device, the alarm spring is designed and biassed to move away from the protective device and towards a contact rail or bar.

If the protective device is heated to a temperature at which the material melts, the main failsafe spring will be released and move towards the protective device, thereby making contact between terminal pins and a centre pin on said device. The alarm spring is released at the same time and moves away from the protective device and into contact with a metal rail or bar mounted in the cover of a cassette in which the protective device is fitted. Because the failsafe device is now earthed through the centre pin on the protective device, both of the terminal pins on the device will be earthed and the metal rail or bar in the cassette cover will also be earthed when the springs are released. The cassette cover is also provided with a light-emitting diode which is connected so as to begin to light-up when one of the protective devices in the cassette has been destroyed. Simple and reliable monitoring and registration of malfunctioning protective devices can be achieved by providing all incoming telecommunications lines with alarm failsafe devices arranged in groups in cassettes connected to a monitoring system.

BRIEF DESCRIPTION OF THE DRAWINGS

FIGS. 6A–6F illustrate a cassette which includes a cover member and which accommodates ten alarm failsafe devices, said Figures also illustrating alarm failsafe devices and a cassette.

BEST MODE OF CARRYING OUT THE INVENTION

Figure 1A:
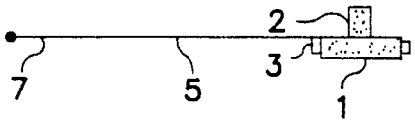
FIGS. 1A, 1B and 1C illustrate a spring element and a pin for an inventive alarm failsafe device, said element and pin being shown in a flat state.
Figure 1B:
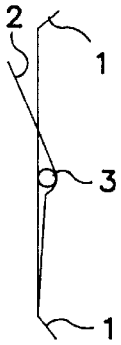
Figure 1C:
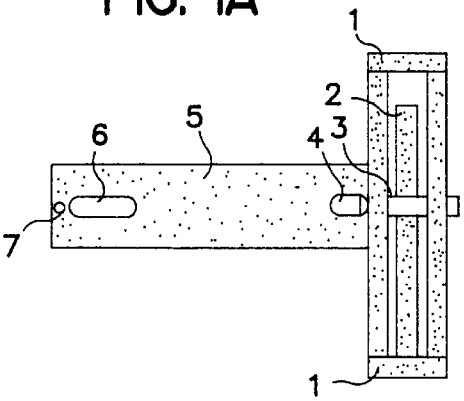
Figure 2A:
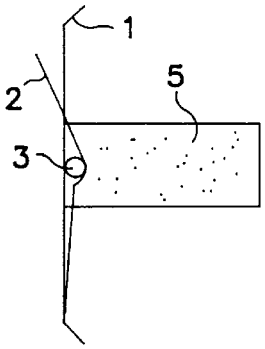
FIGS. 2A, 2B and 2C show the spring element of FIG. 1 bent or curved to fit a three-terminal protective device of the noble gas discharge tube type.
Figure 2B:
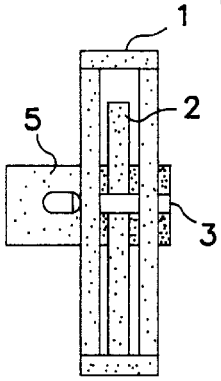
Figure 2C:
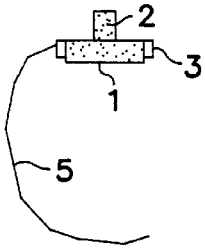
Figure 3A:
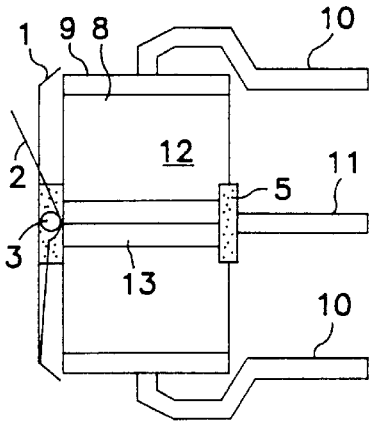
FIGS. 3A, 3B and 3C illustrate an inventive alarm failsafe device.
Figure 3B:
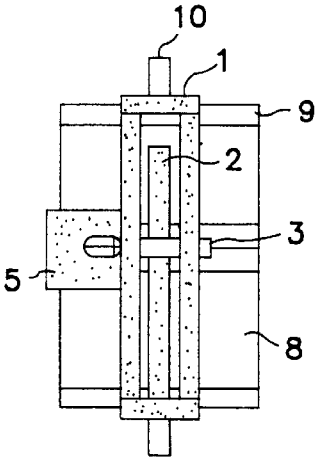
Figure 3C:
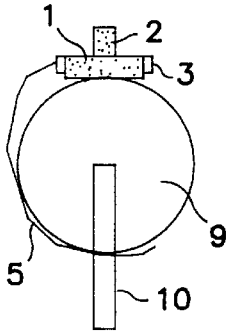

FIGS. 1–3 are detailed views of the spring part of an alarm failsafe device 12. For the sake of illustration, the spring part of the alarm failsafe device is shown in FIG. 1 (comprising FIGS. 1A–1C) in its state prior to being curved and fastened around the cylindrical body of a protective device 8. The spring part of the alarm failsafe device is comprised of a resilient or springy T-shaped plate 5 made of beryllium copper, for instance. The main failsafe spring 1 of the alarm failsafe device is designed so that when released it will contact the end terminals 9 on the protective device 8. The alarm spring 2 of the alarm failsafe device is constructed so that when in its tensioned position, it will lie generally inwardly of the main failsafe spring 1 and is held fixed in this position by means of a meltable rod or pin 3. One end of the meltable pin may be fitted and fixed in a hole 4 on the main failsafe spring 5 of the alarm failsafe device. The main failsafe spring 5 also includes a hole 6 which receives a centre pin 11 provided on the protective device. Reference numeral 7 identifies a connecting point at which the failsafe device is in contact with a centre electrode annulus 13 on the protective body. FIG. 2 (comprising FIGS. 2A–2C) illustrates the alarm failsafe device with the spring part 5 bent or curved for fitting the device to the protective body. FIG. 3 (comprising FIGS. 3A–3C) shows the alarm failsafe device and its main failsafe spring and alarm spring mounted on the protective body 8.

Figure 4:
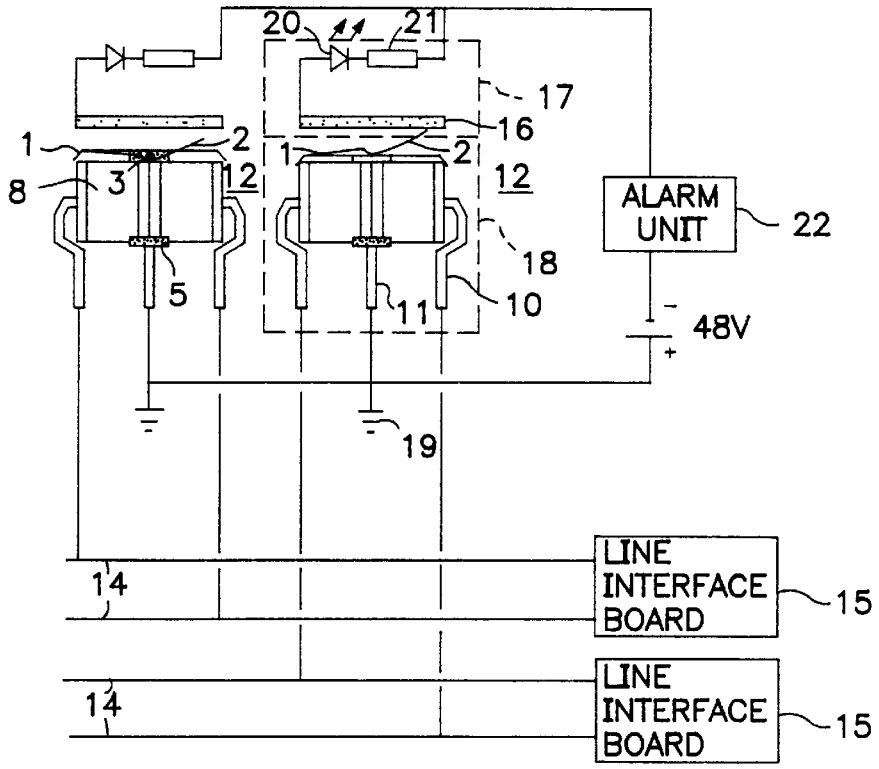
FIG. 4 illustrates inventive alarm failsafe devices connected to the incoming telecommunications lines, where the right protective device has been destroyed.
Figure 5:
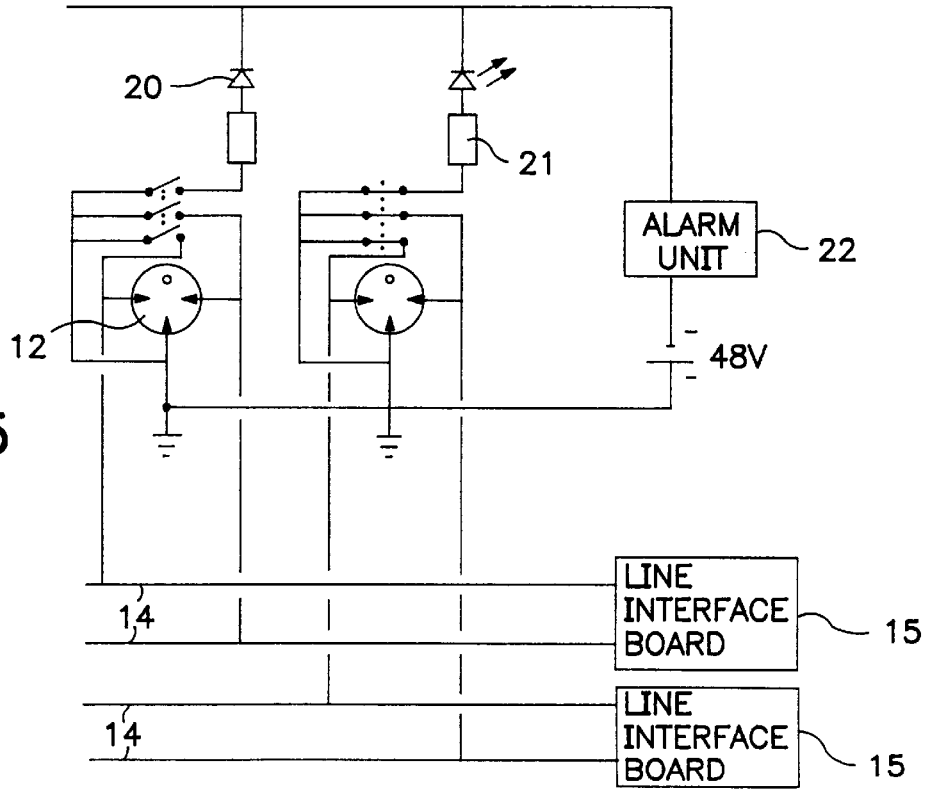
FIG. 5 illustrates an electric circuit corresponding to FIG. 4.

FIG. 4 shows how the protective devices/alarm failsafe devices 12 are coupled to incoming telecommunications lines 14 connected to line interface boards 15, wherein the right protective device has been destroyed in the illustration and its terminal connector pin 10 has been short-circuited via a pin connector 11 in the centre of the main failsafe spring. The alarm spring 2 has moved away from the protective device and is in contact with a metal rail 16 fitted to a cover member 17 on a cassette 18 in which the protective device is mounted. As a result, there is formed an electric circuit which passes from earth 19 to an electrical connection through the alarm failsafe device 12, the metal rail 16, a light-emitting diode 20, a resistor 21 and an alarm unit 22. FIG. 5 illustrates an electric circuit which is equivalent to the circuit shown in FIG. 4.

FIG. 6 (comprising FIGS. 6A–6F) is a simplified illustration which shows how the alarm failsafe devices 12 are adapted for insertion into the cassette 18 and covered with a cover member 17 which incorporates a rail 16 that can be connected to a signal circuit. Also fitted to the cover member 17 is a light-emitting diode 24 which lights-up when the alarm spring 2 of the alarm failsafe device contacts the rail 16 subsequent to melting of the rod 3. FIG. 6A shows the cover member 17 and the light-emitting diode 24 fitted thereto. FIG. 6B shows ten alarm failsafe devices 12 for insertion into respective cassettes 18, as shown in FIG. 6C. FIG. 6D shows the cover member 17 fitted to a cassette 18. FIG. 6E shows the cassette cover member 17 from above, with the light-emitting diode 24 well visible. FIG. 6F shows an enlarged view of one of the alarm failsafe devices show in FIG. 6B.

Figure 7:
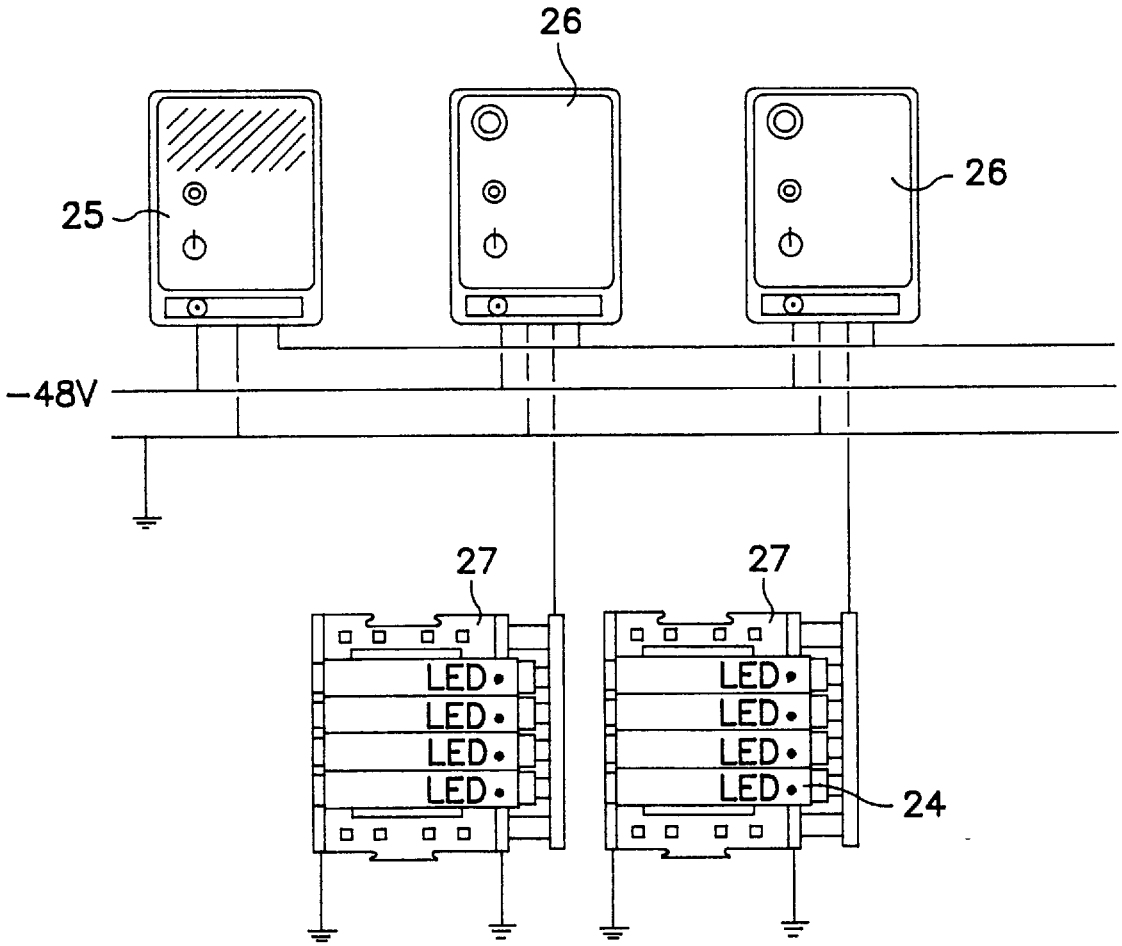
FIG. 7 illustrates a system which includes alarm units and buzzer units connected to cassettes that house alarm failsafe devices.

FIG. 7 illustrates the connection of a respective buzzer unit 25 to the alarm units 26, each of said units being connected to a common voltage source and including a functional electric switch. Each alarm unit is connected to a holder 27 which accommodates a plurality of cassettes (e.g., as shown in FIG. 6). If an overcurrent should cause abnormal heating of an alarm failsafe device, the rod 3 will melt and the alarm circuit will be connected to earth, whereby the light-emitting diode 24 begins to light-up and the alarm unit 26 serving the group of alarm failsafe devices will register this earth connection and deliver a signal to the buzzer unit 25. When a protective device malfunctions, the malfunction is noticed immediately and the buzzer heard by station personnel, whereby the protective device is exchanged for a functioning device.

I claim:

1. A device for registering the malfunction of an overvoltage protective device for telecommunications equipment, wherein abnormal heating of a protective device causing risk of damage releases parts of a spring element, whereby the protective device and a signal circuit are connected to earth, wherein the spring element includes a main failsafe spring and an alarm spring which are mutually separated by meltable material when in a tensioned state and in electrical contact with an earth-connected center pin on the protective device, and when in a released state, in which the springs are released from said tensioned state due to the melting of said meltable material, the springs are also in electrical contact with a device mounted terminal pin and a rail or bar, said device-mounted terminal pin and said rail or bar being connected to earth when in said released state.

2. A device according to claim 1, wherein the meltable material has the form of a rod.

3. A device according to claim 1, wherein said signal circuit is connected to the rail or bar, whereby faults are indicated with the aid of light and/or sound signals in said released stated.

4. A device according to claim 2, wherein said signal circuit is connected to the rail or bar, whereby faults are indicated with the aid of light and/or sound signals in said released state.

5. A system for registering a malfunction in telecommunications equipment, comprising:

a protective device including a terminal connector pin, and a ground pin connected to ground;

a housing member for housing said protective device, said housing member including a conductive member attached thereto;

a main failsafe switch for connecting said terminal connector pin to ground through said ground pin in the event of an overvoltage;

an alarm switch for connecting said conductive member attached to said housing member to ground in the event of said overvoltage; and an overvoltage sensitive member for contacting both said main failsafe switch and said alarm switch, and for retracting both said main failsafe switch and said alarm switch in a normal operating state of said telecommunications equipment, and for releasing both switches in the event of said overvoltage;

wherein said alarm switch contacts said conductive member in said housing in response to said overvoltage, which causes the generation of a perceptible alarm.

6. The system of claim 5, wherein said overvoltage sensitive member comprises a meltable member comprising a meltable material which melts in response to heat generated by said overvoltage.

7. The system of claim 5, wherein said main failsafe switch and said alarm switch are mutually separated by said overvoltage sensitive member.

8. The system of claim 7, wherein said overvoltage sensitive member is shaped in rod-like form.

9. The system of claim 5, wherein said housing member comprises a cassette having a cassette cover.

10. The system of claim 9, wherein said conductive member is disposed in said cassette cover.

11. The system of claim 5, further including a light emitting device for generating a visible perceptible alarm in response to said overvoltage.

12. The system of claim 5, further including a sound emitting device for generating an audible perceptible alarm in response to said overvoltage.

* * * * *